United States Patent [19]

Kasugai

[11] Patent Number: 4,875,415

[45] Date of Patent: Oct. 24, 1989

[54] ROTARY JACK ASSEMBLY FOR A CRANE

[75] Inventor: Heki Kasugai, Kobe, Japan

[73] Assignee: Mitsubishi Jukogyo Kabushiki Kaisha, Tokyo, Japan

[21] Appl. No.: 213,473

[22] Filed: Jun. 29, 1988

Related U.S. Application Data

[63] Continuation of Ser. No. 888,434, Jul. 23, 1986, abandoned.

[30] Foreign Application Priority Data

Oct. 28, 1985 [JP] Japan ..... 60-164104

[51] Int. Cl.[4] ..... B61J 1/02; B61B 13/12

[52] U.S. Cl. ..... 104/35; 105/163.1

[58] Field of Search ..... 104/35, 36; 105/157.1, 105/157 R, 158.1, 163.1, 163 R, 177; 254/421, 2 R

[56] References Cited

U.S. PATENT DOCUMENTS

| | | | |
|---|---|---|---|
| 2,495,813 | 1/1950 | Jones | 105/163.1 X |
| 3,640,503 | 2/1972 | Spannlang | 254/421 X |
| 3,918,682 | 11/1975 | Despalmes | 105/177 X |
| 3,949,884 | 4/1976 | Despalmes | 105/177 X |
| 4,123,038 | 10/1978 | Meyers | 254/2 R |
| 4,161,144 | 7/1979 | Raugulis et al. | 105/163.1 |
| 4,188,887 | 2/1980 | Dewing et al. | 105/163.1 |

*Primary Examiner*—Johnny D. Cherry
*Assistant Examiner*—Joseph D. Pape
*Attorney, Agent, or Firm*—Wenderoth, Lind & Ponack

[57] ABSTRACT

There is disclosed a rotary jack assembly which comprises a rotary frame assembly having first and second frames each having frame receiving members, a plurality of pairs of wheel frames are provided under the first frame receiving members at points above where a circular rail on which the wheel frames ride is placed, the frame assembly is vertically shiftable relative to the wheel frames by means of cylinders. A plurality of crane supporting arms are arranged on the frame assembly and spaced from the cylinders for vertically shifting the frame assembly. Cylinders are connected to the crane supporting arms to slide the crane supporting arms out of the frame assembly for supporting a crane thereon.

2 Claims, 5 Drawing Sheets

ROTARY JACK ASSEMBLY FOR A CRANE

This application is a continuation, of now abandoned application Ser. No. 888,434, filed July 23, 1986 abandoned.

BACKGROUND OF THE INVENTION

1. Field of the invention

The present invention relates to a rotary jack assembly for lifting and rotating a quayside crane use din a wharf to change the travel of the crane.

2. Description of the Prior Ar

As shown in FIG. 4, a crane runs on a rails 10*a* extending along one side of a wharf and rails along the other side of the wharf. Surrounded by the rails 10*a* and 10*b* is a circular rail 10*c* on which a conventional jack assembly runs. The jack assembly is intended to lift and rotate the crane to change its travel, from the rails 10*a* to the rails 10*b* and vice versa. The jack assembly generally includes a rotary frame assembly 1, 2 having frames 1, 1, 2 and 2, frame receiving members 3, wheel frames 4 provided under the frame receiving members 3 to rotatably support wheels, and a plurality of crane supporting arms 5 assembled in the respective frame receiving members 3 to extend out of and retreat into the frame assembly. The crane generally includes a right and left sill 7, 7, a plurality of legs 8, and a plurality of wheels 9. In the drawing, reference numeral 11 denotes a rail reversal unit. Reference numerals 12 and 13 denote stoppers.

Specifically, a vertical cylindrical housing 15 is fitted in each frame receiving member 3 of the rotary frame assembly and is connected to the wheel frame 4 by a pin 19 as shown in FIG. 5(B). A hydraulic cylinder 14 is arranged vertically in the cylindrical housing 15 and has a piston rod 14*a* connected to the frame receiving member 3 by a pin. Each crane supporting arm 5 is slidably arranged in the frame receiving member 3 and has a bifurcated portion 5*a* at its base in an attempt to avoid the cylindrical shaft 15. A hydraulic cylinder 17 is mounted in the frame 1 and has a piston rod 17*a* connected to the bifurcated portion 5*a*. With this arrangement, the hydraulic cylinderes 17 are operated to move the crane supporting arms 5 out of the frames 1, 2 to thereby position them under the right and left sill 7, 7 of the crane. The hydraulic cylinders 14 are then operated to raise the frame assembly 1, 2 together with the frame receiving mbmers 3 and the crane supporting arms 5 whereby the crane is lifted via the sills 7, 7. Reference numeral 20 denotes pads.

The travel of the crane is changed as follows:

The crane first runs on the rails 10*a* in a direction as indicated by the arrow ↗ as shown in FIG. 4. The crane stops when the wheels come into engagement with the stoppers 12 and is located above the jack assembly.

Next, the hydraulic cylinders 17 are operated to move the crane supporting arms 5 out of the frames 1, 2 and to thereby position them under the right and left sill 7, 7 (see FIG.5). The hydraulic cylinders 14 are then operated to raise the crane supporting arms 5 together with the frame assembly 1, 2 and the frame receiving members 3. Hereby the crane is lifted via the right and left sill 7, 7 (see FIG>6). In this state, the jack assembly and the crane are rotated approximately 90°. Thereafter, the hydraulic cylinders 14 are operated to lower the frame assembly together with the crane supporting arms 5. The hydraulic cylinders 17 are then operated to retreat the crane supporting arms 5 into the interior of the frames 1, 2. The crane is now located on the rails 10*b* and runs in a direction as indicated by the arrow↗. The crane can be moved back to the rails 10*a* from the rails 10*b* by reversing the forgoing operation.

In such a conventional rotary jack assembly, however, each crane supporting arm 5 must be bifurcated as at 5*a* at its base so as to avoid the cylindrical shafat 15 in the frame receiving member 3 and to allow sliding movement of the crane supporting arm 5 in the frame 1. However, this results in an increase in the width and size of the frame receiving members (3). Thus, the crane supporting arms become complicated and unstable. In the case that the height of the sills is low, lifting of the crane may not be smoothly effected because the height of the crane supporting arms can not be lowered.

SUMMARY OF THE INVENTION

It is an object of the present invention to provide an improved rotary jack assembly for a crane.

Another object of the invention is to provide a rotary jack assembly for a crane, which enables lowering of a crane jack assembly.

A further object of the invention is to provide a rotary jack assembly for a crane, which facilitates sliding movement of crane supporting arms.

Still another object of the invention is to provide a rotary jack assembly for a crane, which enables simplification of crane supporting arms.

According to the present invention, there is provided a rotary jack assembly for a crane, which comprises a rotary frame assembly, a plurality of pairs of wheel frames provided oppositely at the center of the frame assembly, said frame assembly being vertically shiftable relative to the wheel frames by means of cylinders, a plurality of crane supporting arms arranged in opposite ends of the frame assembly, and cylinders connected to the crane supporting arms to slide the arms out of the frame assembly.

The above and other objects, features and advantages of the invention will become more clear from a consideration of the following detailed description when taken in conjunction with the accompanying drawings.

DESCRIPTION OF THE PREFERRED EMBODIMENT

Figure 1A:
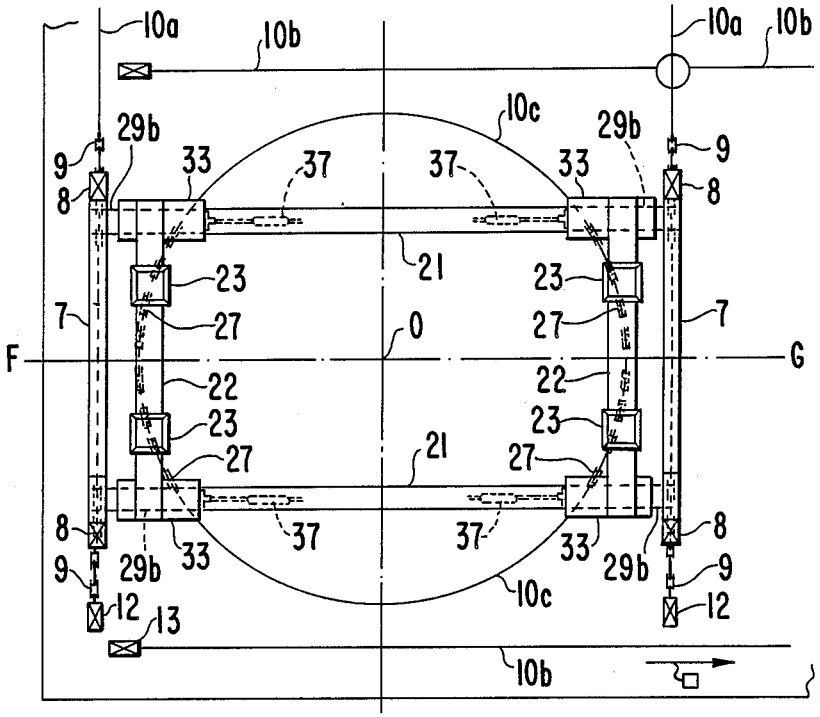
FIG. 1(A) is a top plan view of a rotary jack assembly according to one embodiment of the present invention.
Figure 1B:
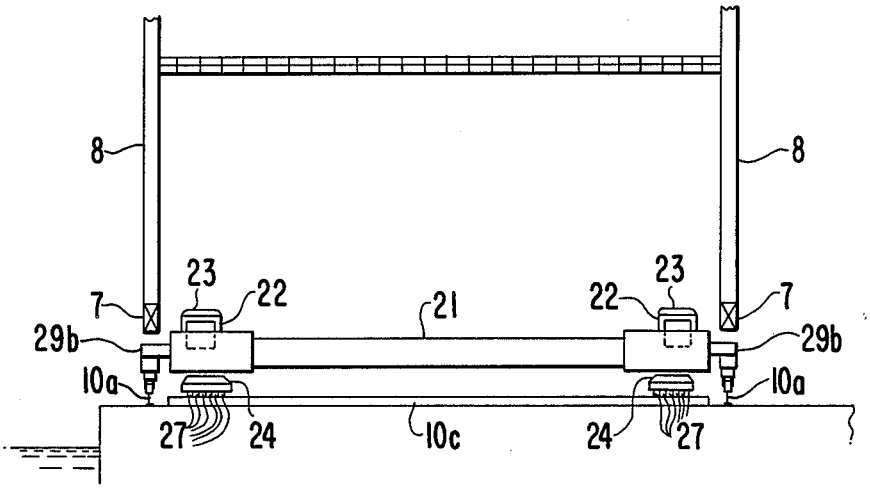
FIG. 1(B) is a front elevation of the jack assembly shown in FIG. 1(A)
Figure 2A:
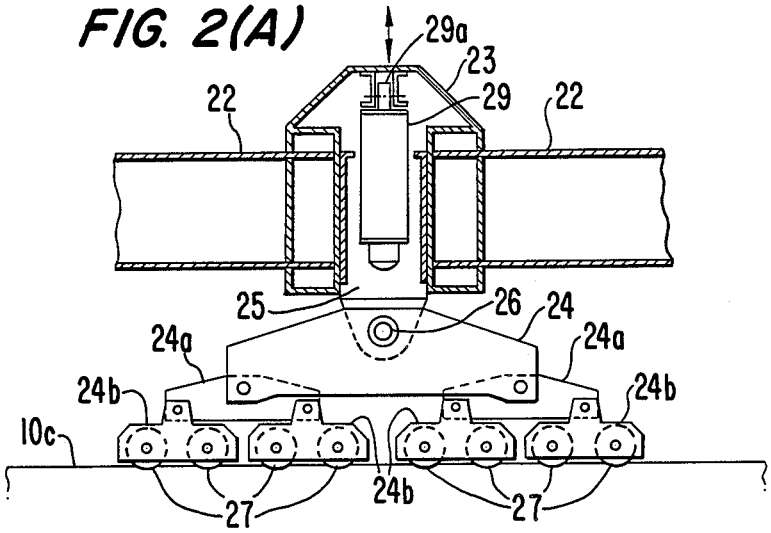
FIG. 2(A) is a partial vertical sectional view of a wheel frame and frame assembly.
Figure 2B:
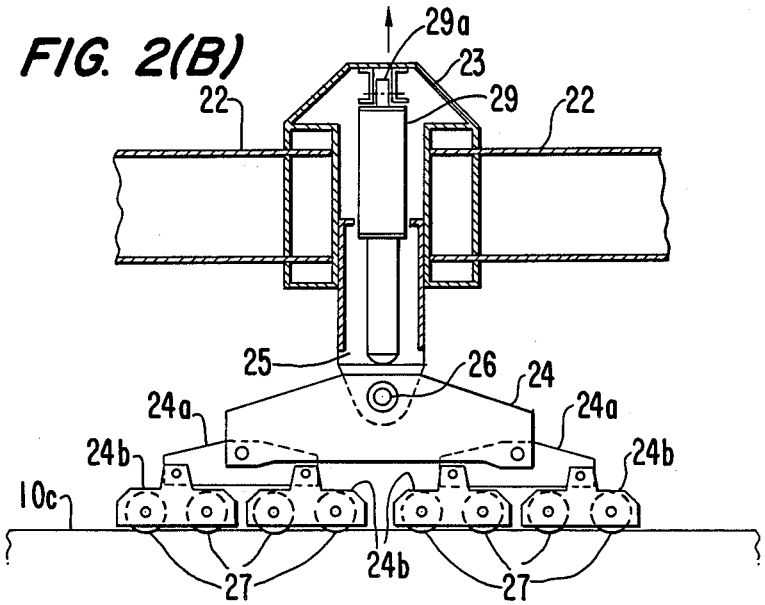
FIG. 2(B) is the wheel frame and frame assembly of FIG. 2(A) as the hydraulic cylinder is extending to elevate the frame assembly relative to the wheel frame.
Figure 2C:
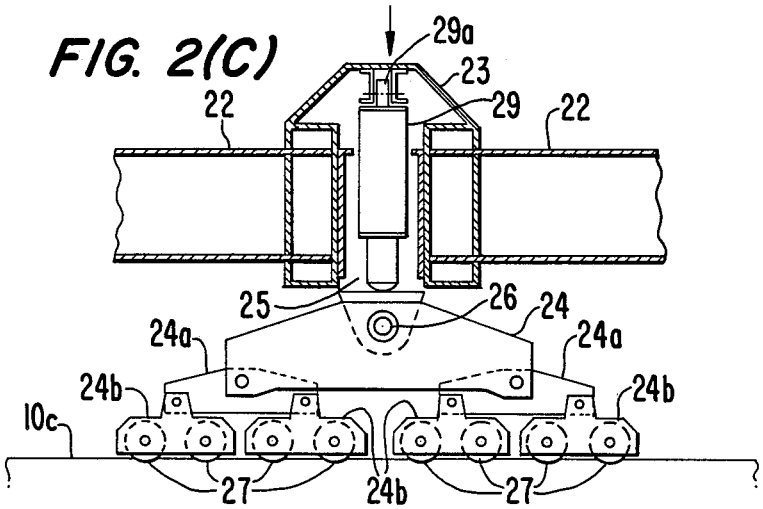
FIG. 2(C) is the wheel frame and frame assembly of FIG. 2(A) as the frame assembly is descending.
Figure 3A:
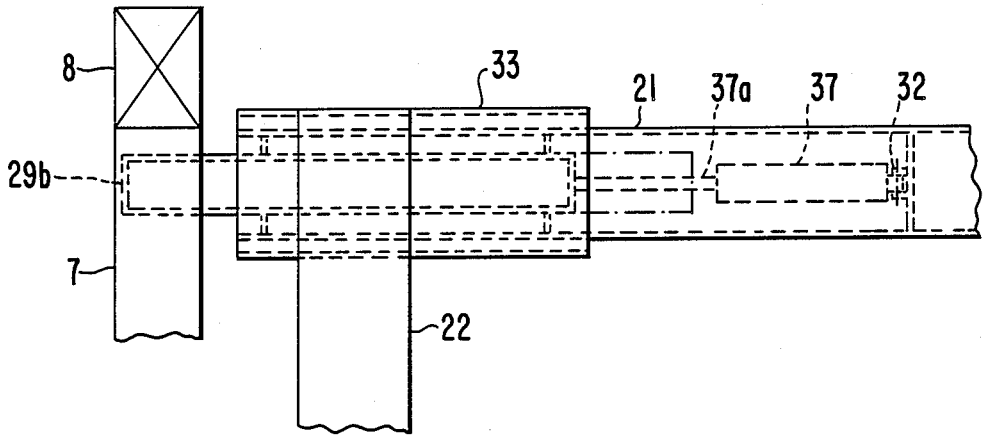
FIG. 3(A) is a top plan view showing the manner in which a crane supporting arm is arranged in a frame.

FIGS. 1 to 3 show one embodiment of the present invention. In FIG. 1, reference numerals 10*a*, 10*b* denote rails extending on a wharf. Reference numeral (10*c*) denotes a circular rail provided in the area surrounded by intersecing rails 10*a* and (10*b*). Also, reference numerals 12 and 13 denote stoppers. Reference numerals 7, 7 denote a right and left sill of a crane. Reference numerals 8, 8 denote legs of the crane. Reference numeral 9 denotes wheels. A rotary jack assembly is placed on the rail 10*c* and includes a frame assembly 21, 22 having frames 21, 21, 22, 22. Wheel frames 24 (two pairs of wheels are shown) are provided at the center of the frames 22,22 (in other words, the wheel frames 24 are provided under the frames 22 away from the intersection between the frames 21 and 22) and are vertically shiftable relative to frames 22 by means of hydraulic cylinders 19. A plurality of crane supporting arms (29*b*) are slidably arranged in opposite ends of the frames 21, 21 of the frame assembly 21, 22 and are movable out thereof. Each crane supporting arm (29*b*) is connected to a hydraulic cylinder 37 which is, in turn, pivotably mounted to the frame 21.

Reference is made further to the wheel frames 24. As shown in FIGS. 1 and 2(A)-(C), each frame 22 has a pair of first frame receiving mbmers 23, 23 at its center. Fitted in each of the frame receiving members is a vertical cylindrical shaft or housing 25 which is connected to the wheel frame 24 by a pin 26. A hydraulic cylinder 29 is vertically arranged in each cylinder housing 25 and has an attachment member 29*a* which is, in turn, connected to the first frame receiving member 23. Cylinder 29 also has, of course, an extensible rod (unnumbered) for contacting the inside bottom of vertical cylindrical shaft or housing 25 when extending downwardly (as viewed in FIGS. 2(A)-(C) by hydraulic cylinder 29. With this arrangement, the frame assembly 21, 22 is verticlaly shiftable relative to the wheel frames 24, 24 by means of the hydraulic cylinders 29 via the first frame receiving members 23. As to the four wheel frames, each pair of wheel frames is oppositely positioned relative to a center line (F—O—G) as shown in FIG. 1(A).

As can be seen in FIGS. 2(A)-(C), frame 22 is secured to one of the pair of first frame receiving members 23. First frame receiving member 23 is, in turn, connected to cylinder 29 via attachment member 29*a*. Vertical cylindrical housing 25 is connected to wheel frame 24 by pin 26.

Figure 3B:
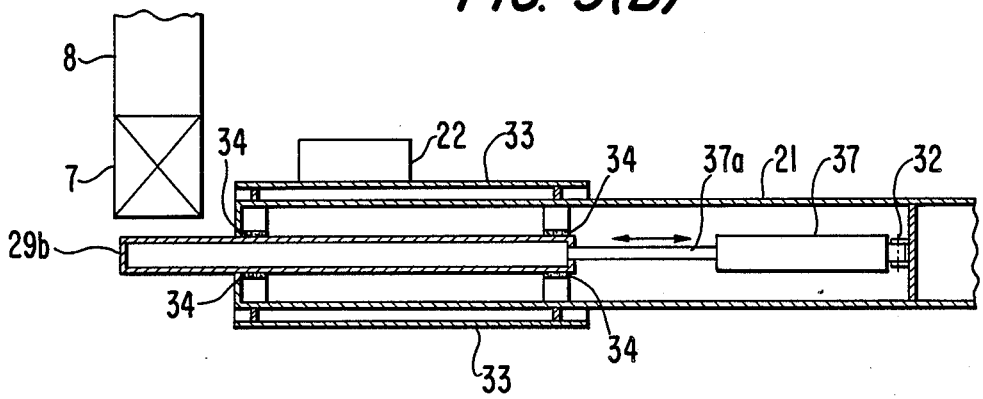
FIG. 3(B) is a vertical sectional view of the crane supporting arm shown in FIG. 3(A)
Figure 4A:
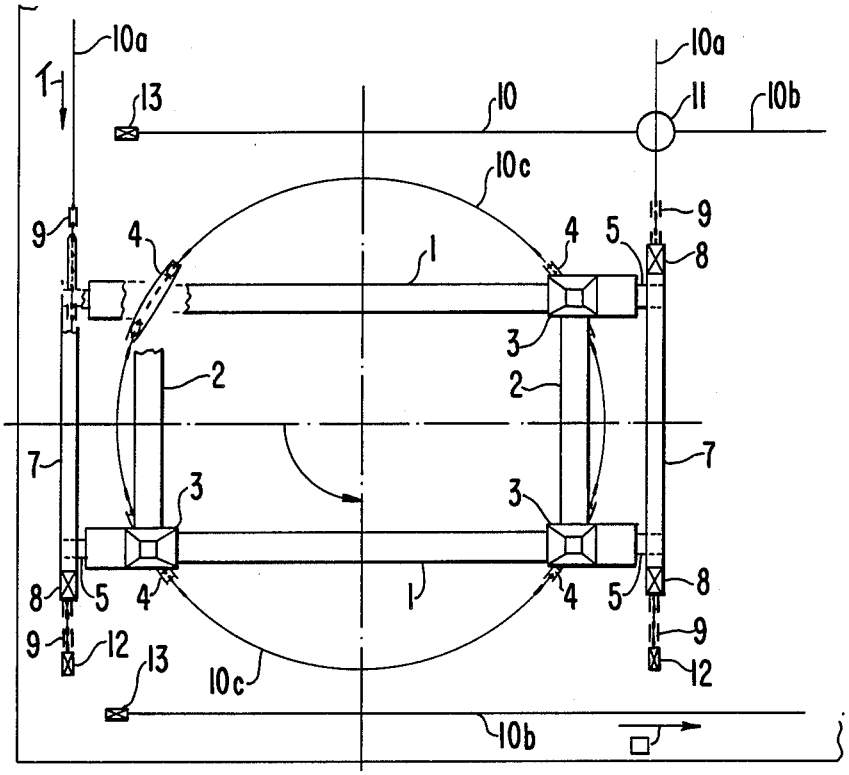
FIG. 4(A) PRIOR ART
FIGS. 4(A) and (B) are top plane and front views of a conventional jack assembly.
Figure 4B:
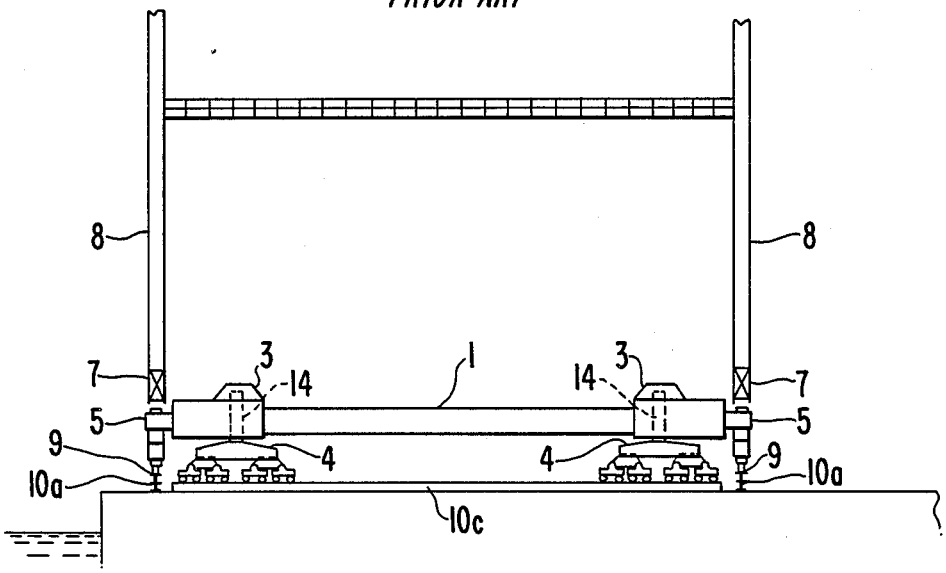
FIG. 4(B) PRIOR ART
Figure 5A:
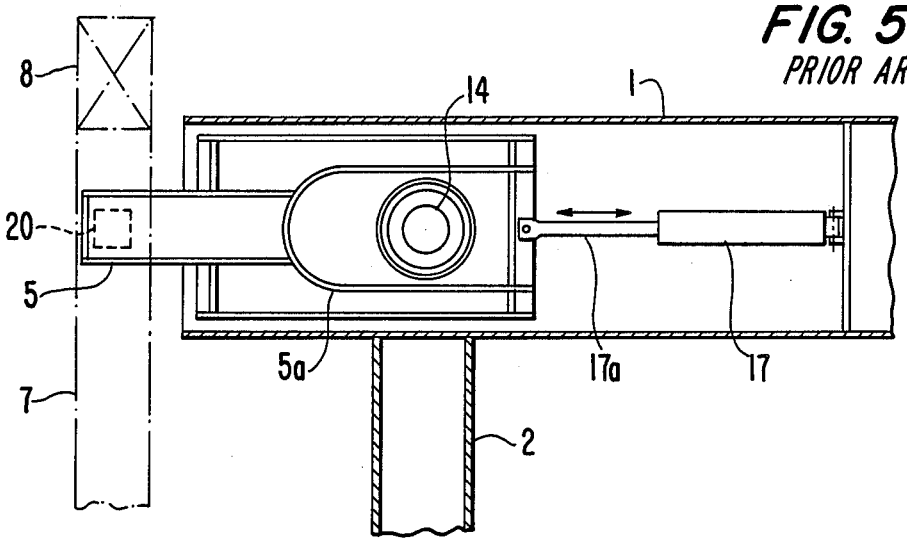
FIG. 5(A) PRIOR ART
FIGS. 5(A) and 5(B) are transverse and vertical sectional views of a crane supporting arm arranged in a frame.
Figure 5B:
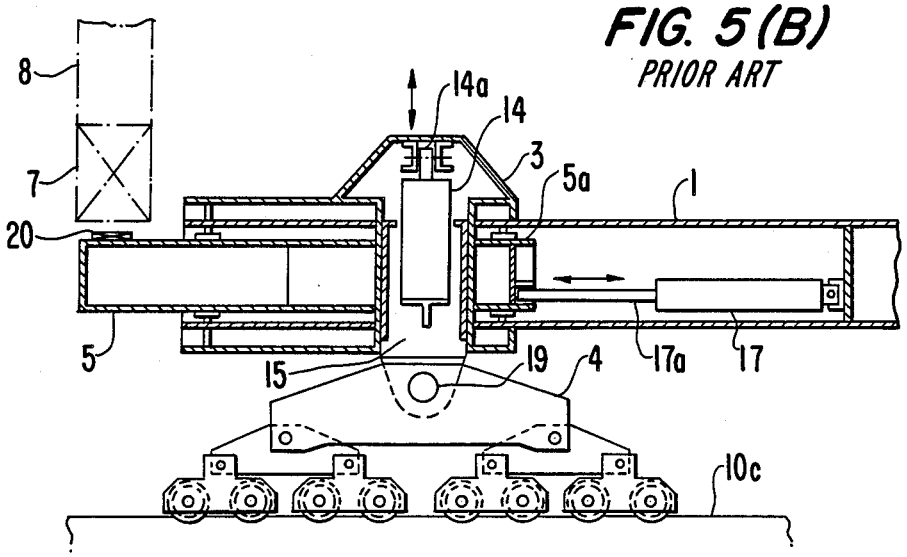
FIG. 5(B) PRIOR ART
Figure 6:
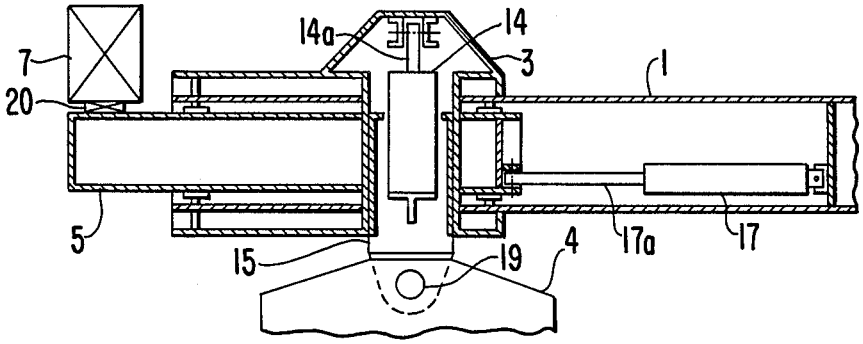
FIG. 6 PRIOR ART
FIG. 6 is a view showing the crane supporting arm of FIG. 5(A) in use.

Pivotably connected to each wheel frame 24 are two middle wheel frames 24*a*, 24*a*, each middle wheel frame being pivotably connected to a pair of lower small wheel frames 24*b*, 24*b*. Each pair of lower sheel frames 24*b* rotatably support a plurality of wheels 27 on the rail 10*c*. Reference is now made in more detail to the crane supporting arms 29*b*. As shown in FIGS. 1 to 3, the second frame receiving members 33 are provided at their opposite ends with the crane supporting arms 29*b* via anti-friction members 34 (see FIG. 3B), said crane supporting arms 29*b* being slidably movable out of the frames 21, 21. Hydraulic cylinders 37 are arranged in the frames 21, 21 and are pivotably connected thereto by pins 32. Each hydraulic cylinder 37 has a piston rod 37*a* which is connected to the crane supporting arm 29*b*. With this arrangement, the cylinders 37 are operated to extend the crane supporting arms 29*b* out of the frame assembly 21, 22.

The frames 22, 22 are higher than the frames 21, 21 as the second frame receiving members 33 are present therebetween. This enables lowering of the crane supporting arms 29*b* (see FIGS. 2(A)-(C) and 3(B)). Also, since the wheel frames 24 are positioned at the center of the frames 22, 22, the crane supporting arms 29*b* can be positioned low, and thus placed under the sills of the crane, if such sills are relatively low.

In operation, while the crane is placed on the jack assembly, the hydraulic cylinders 37 are operaated to extend the crane supporting arms 29*b* from the opposite ends of of the frame assembly 21, 22. The cylinders 29 are then operated to raise the frame assembly 21, 22 with the crane supporting arms 29*b* relative to the wheel frames 24.

Cylinders 29 raise frames 21 and 22 (and, of course, frame receiving members 23) relative to wheel frames 24 by extending the unnumbered rod of cylinders 29 (as seen in FIG. 2(B)) until the rod contacts the inside bottom of housing 25. As the rod is further extended the frame receiving member 23 is moved vertically away from wheel frames 24 and frame receiving members 23 move along frame assembly 21, 22 vertically upwardly at the same time.

Hereby, the crane is lifted by the crane supporting arms 29*b* via the sills 7, 7. Thereafter, the jack assembly and the crane are rotated 90°. For rotation the wheels 27 move on the circular rail, and wheel frames 24, housing 25, cylinder 29, frame receiving members 23, and frames 21 and 22 are rotated as a whole concurrently in a substantially horizontal plane. The hydraulic cylinders 29 are again operated to lower the frame assembly 21, 22 (FIG. 2(C)) and the crane supporting arms 29*b*. Also, the cylinders 37 are operated to retract the crane supporting arms 29*b* into the frame assembly. The crane is now transferred from the rails 10*a* to the rails 10*b* and runs in a direction as indicated by the arrow $\acute{\Delta}$.

While the preferred embodiment of the invention has been shown and described, it will be apparent that various changes and modifications may be made therein. It is, therefore, to be understood that it is not intended to limit the invention to be the embodimentn shown, but only by the scope of the appended claims.

What is claimed is:

1. A rotary jack assembly for supporting a crane comprising:

a substantially horizontal frame assembly, said frame assembly including a first and a second pair of elongated spaced opposed substantially parallel frames, said first and second pairs of frames being substantially perpendicular to each other and intersecting each other at respective fixed intersections, said first pair of frames being an upper pair of frames, said second pair of frames being a lower pair of frames, and said second pair of frames being disposed below said first pair of frames and being fixedly attached to said first pair of frames at said fixed intersections, and;

a plurality of wheel frames for supporting said frame assembly being attached to the underside of each one of opposed frames of said first pair of said first and second pairs of frames, and each one of said plurality of wheel frames being spaced from each one of said fixed intersections of said first and second pairs of frames;

means for vertically shifting said frame assembly relative to said plurality of wheel frames, said means for vertically shifting being attached to each of said plurality of wheel frames, and said means for vertically shifting being attached to said frame assembly on said first pair of frames;

a plurality of crane supporting arms for supporting a crane thereon, said plurality of crane supporting arms being located at opposite ends of said frame assembly, and being relatively movable to said frame assembly;

means for attaching said plurality of crane supporting arms to said frame assembly on said second pair of said first and second pairs of frames to which said plurality of wheel frames is not attached, and for horizontally shifting each arm of said plurality of crane supporting arms outwardly of said frame assembly, said means for attaching and horizontally shifting being attached to each said crane supporting arm, and said means for attaching and horizontally shifting being separate from and horizontally spaced from said means for vertically shifting said frame assembly; and each said crane supporting arm being separate from and horizontally spaced from each said means for vertically shifting said frame assembly relative to said plurality of wheel frames.

2. A rotary jack assembly as in claim 1, wherein each wheel frame of said plurality of wheel frames has rail engageable wheels for running on a rail, each said means for attaching and horizontally shifting said plurality of crane supportingn arms is enclosed within said second pair of frames of said frame assembly, and each said crane supporting arm is retractable substantially completely into said second pair of frames of said frame assembly.

* * * * *